US005374232A

United States Patent [19]

Cipollone

[11] Patent Number: 5,374,232

[45] Date of Patent: Dec. 20, 1994

[54] METHOD OF MAKING A GIFT BAG

[75] Inventor: Frank J. Cipollone, Edgewood, Ky.

[73] Assignee: Equitable Bag Co., Inc., Astoria, N.Y.

[21] Appl. No.: 115,222

[22] Filed: Sep. 1, 1993

[51] Int. Cl.[5] ..... B31B 23/86; B31B 23/14; B31B 23/90

[52] U.S. Cl. ..... 493/194; 493/225

[58] Field of Search ..... 493/194, 195, 196, 225, 493/928, 955, 962

[56] References Cited

U.S. PATENT DOCUMENTS

| | | | |
|---|---|---|---|
| 3,687,357 | 8/1972 | Hansen | 383/72 |
| 4,608,283 | 8/1986 | White | 428/4 |
| 4,664,649 | 5/1987 | Johnson et al. | 493/197 |
| 4,714,455 | 12/1987 | Herrington | 493/225 |
| 4,777,066 | 10/1988 | White et al. | 428/4 |
| 4,792,241 | 12/1988 | Broderick et al. | 383/75 |
| 5,057,065 | 10/1991 | Buchman | 493/194 |
| 5,161,895 | 11/1992 | Myers | 383/72 |

*Primary Examiner*—William E. Terrell
*Attorney, Agent, or Firm*—Brumbaugh, Graves, Donohue & Raymond

[57] ABSTRACT

A method of making a gift bag which contains a pair of ribbon loops in the neck which, when pulled in opposite directions, form a cluster at the top of the bag about which the ribbons can be tied to form a fancy package.

The method of in-line production of such gift bags includes laying a pair of ribbons near opposite edges of a sheet and folding the edges to form flaps over the ribbon; folding the sheet longitudinally at the middle, punching spaced-apart holes in the sheet-enfolded flaps at intervals corresponding to the width of the bag; guiding the ribbons into registry with the punched holes; sealing along a transverse zone passing through the middle of the punched hole and cutting along the transverse zone to separate the bags.

3 Claims, 2 Drawing Sheets

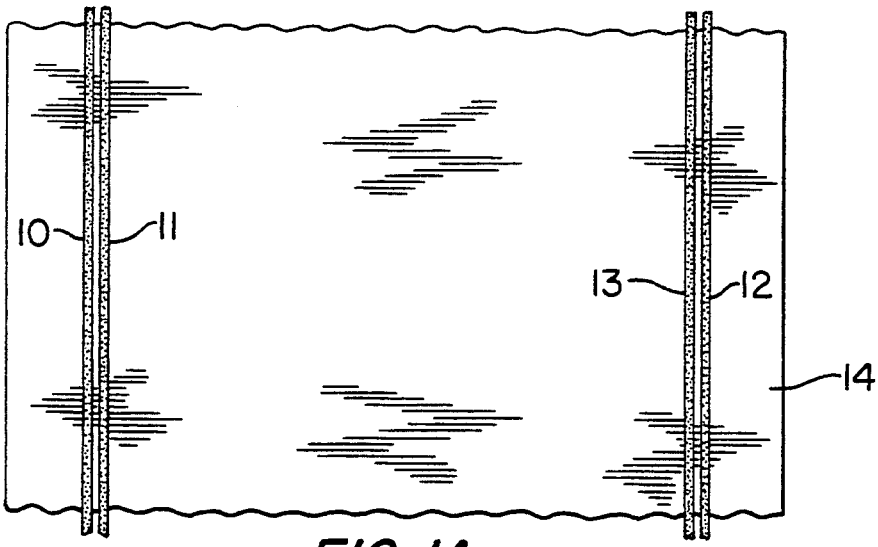
FIG. 1A
FIG. 1B
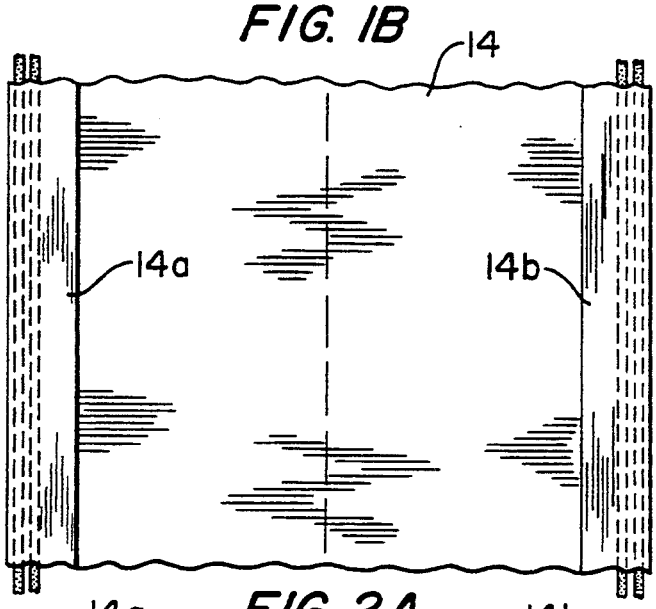
FIG. 2A
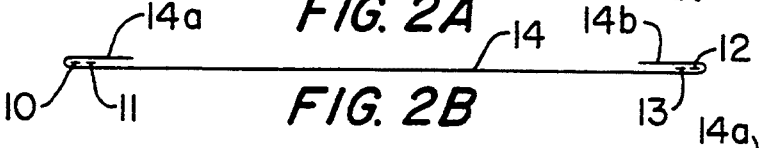
FIG. 2B
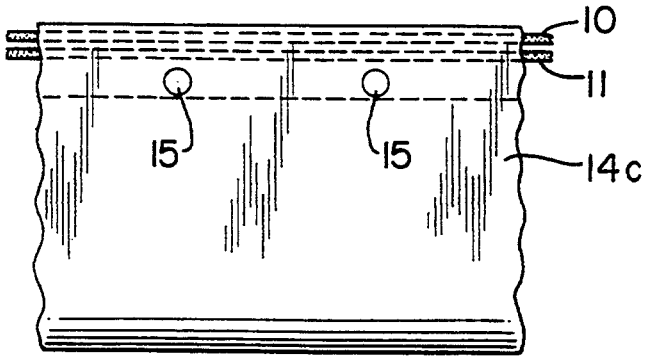
FIG. 3A
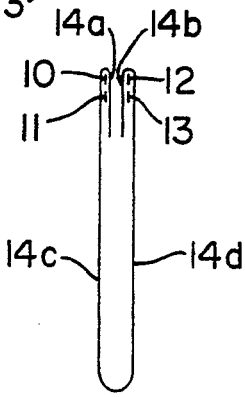
FIG. 3B

METHOD OF MAKING A GIFT BAG

This invention relates to a method of making a gift bag which contains a pair of ribbon loops in the neck which, when pulled in opposite directions, form a cluster at the top of the bag about which the ribbons can be tied to form a fancy package. The invention also relates to gift bags made by said method.

BACKGROUND OF THE INVENTION

Gift bags having draw ribbons to close the bag and tie a bow around the neck of the bag are known, and examples of such gift bags are disclosed in U.S. Pat. Nos. 4608283, 4777066 and 5161895. Also bags which contain pairs of strings or tapes in the neck which, when pulled in opposite directions, are known, and examples are disclosed in U.S. Pat. Nos. 3687357 and 4792241.

SUMMARY OF THE INVENTION

The present invention relates to a method for the in-line production of gift bags which contain a pail of ribbon loops in the neck which, when pulled in opposite directions, form a cluster at the top of the bag about which the ribbons can be tied to form a fancy package.

The method of the present invention comprises the steps of: laying a pair of side-by-side longitudinally extending thermoplastic ribbons near opposite edges of a longitudinally extending thermoplastic sheet; folding the opposite edges transversely over the respective pairs of ribbons along longitudinal fold lines which form the upper ends of the bag; folding the sheet longitudinally along the middle to form the bottom and the walls of the bag and bringing the longitudinal fold lines forming the upper ends of the bag in side-by-side relationship; with each pair of ribbons interposed between a wall and a folded flap and being located in proximity to the fold line connecting the wall and the folded flap, punching holes through the walls and folded flaps at longitudinal distances corresponding to the width of the bag and at a location spaced transversely from the fold lines connecting the wall with their respective folded flaps to avoid punching the pairs of ribbons; displacing the pairs of ribbons transversely into registry with the punched holes; sealing the overlying walls, folded flaps and ribbons along a transverse zone passing through the middle of a punched hole; and cutting along the transverse zone to separate the bags. The transverse sealing step forms two pairs of ribbon loops which are accessible through the punched holes at opposite edges of the bag so that the ribbon loops can be pulled in opposite directions to form a cluster at the top of the bag about which the ribbons can be tied to form a fancy package.

DESCRIPTION OF THE DRAWINGS

For an understanding of the invention, reference can be made to the detailed description which follows and to the accompanying drawings in which:

FIG. 1A is a top view of a longitudinally extending thermoplastic sheet with a pair of longitudinally extending ribbons near opposite edges of the sheet;

FIG. 1B is a schematic cross sectional view of FIG. 1A;

FIG. 2A is a view similar to FIG. 1A showing the opposite edges of the sheet folded over the respective pairs of ribbons;

FIG. 2B is a schematic cross sectional view of FIG. 2A;

FIG. 3A is an elevational view of the sheet shown in FIG. 2A after the sheet has been folded longitudinally;

FIG. 3B is a schematic sectional view of FIG. 3A;

DESCRIPTION OF PREFERRED EMBODIMENT

In the in-line production of the gift bags, as shown in FIG. 1A, pairs of thermoplastic ribbons 10, 11 and 12, 13 are fed longitudinally and continuously over a longitudinally and continuously fed thermoplastic sheet 14, and the ribbons 10, 11 are deposited on the sheet near one longitudinal edge and the ribbons 12, 13 are deposited on the sheet near the opposite longitudinal edge.

As shown in FIG. 2A, with the sheet being continuously fed in the longitudinal direction, the opposite edges of the sheet are folded transversely over the respective pairs of ribbons along longitudinal fold lines which become the upper ends of the bag. The transversely folded opposite edges of the sheet form folded flaps **14*a*, 14*b*. The sheet 14 is then folded longitudinally along the middle (shown by a broken line in FIG. 2A) to form the bottom and the wall panels 14*c*, 14*d*** of the bag, as shown in FIGS. 3A and 3B. The continuous feed of the sheet and ribbons is now changed to an intermittent feed by passing the sheet and ribbons around take-up rolls.

With the ribbons 10, 11 interposed between the wall panel **14*c* and the folded flap 14*a* and the ribbons 12, 13 interposed between the wall panel 14*d* and the folded flap 14*b* and with both pairs of ribbons located in proximity to the fold line connecting each wall panel and its respective folded flap, holes 15** are punched through the walls and folded flaps at longitudinal distances corresponding to the width of the bag and at locations spaced transversely from the fold lines connecting the walls and their respective folded flaps to avoid punching the ribbons.

Figure 4:
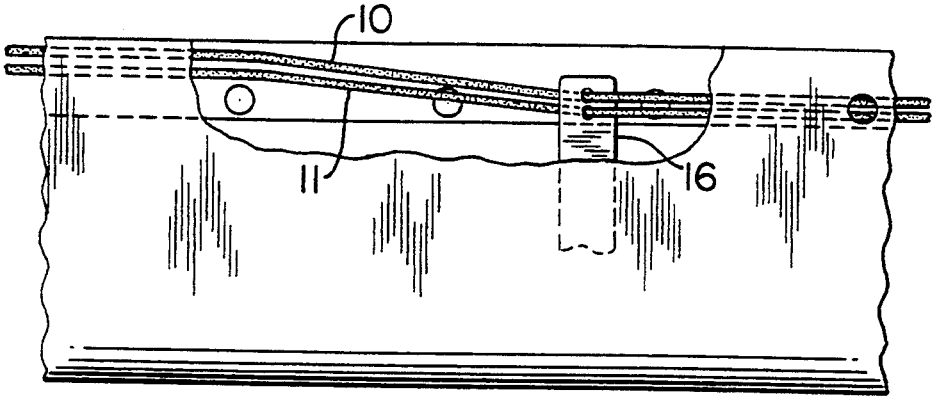
FIG. 4 is a view similar to FIG. 3A with a part of a wall broken away to show the displacement of a pair of ribbons into registry with the punched holes.
Figure 6:
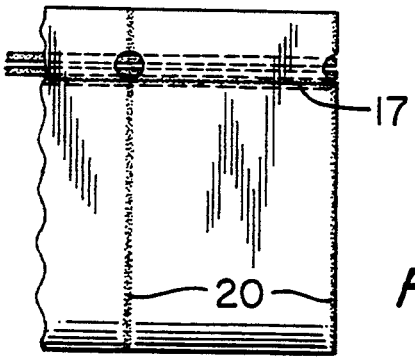
FIG. 6 shows the sealing of the overlying wall panels, folded flaps and ribbons along a transverse zone through the middle of the punched hole and the cutting of the bags along the transverse zone to separate the bags.

After the holes 15 have been punched, the pairs of ribbons are displaced transversely into registry with the punched holes. This is accomplished, as shown in FIG. 4, by interposing ribbon guide plates 16 between the wall panel **14*c* and the folded flap 14*a* and between the wall panel 14*d* and the folded flap 14*b*, the ribbons passing through guide openings in the guide plates 16**.

Figure 5:
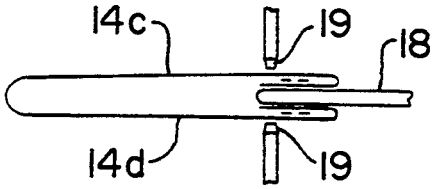
FIG. 5 is a schematic cross sectional view showing the longitudinal sealing of the folded flaps to the adjacent wall panels.

Longitudinal seals 17 are formed between the inner edges of the folded flaps **14*a*, 14*b* and their respective wall panels 14*c*, 14*d* by interposing a Teflon coated separating plate 18 between the folded flaps 14*a*, 14*b* and bringing longitudinally extending heated bars 19 against the outer wall panels 14*c*, 14*d*** of the bags, as shown in FIG. 5.

The overlying wall panels, folded flaps and ribbons are now sealed along a transverse zone 20 by heated bars. The transverse zone 20 passes through the middle of the punched hole 15 to form the closed side edges of the bag. At the same time, opposite ends of the upper ribbons 10, 12 and the lower ribbons 11, 13 are sealed together to form upper and lower ribbon loops. The bags are then separated by transversely cutting the bags along the transverse zone 20 by a heated knife.

Figure 7:
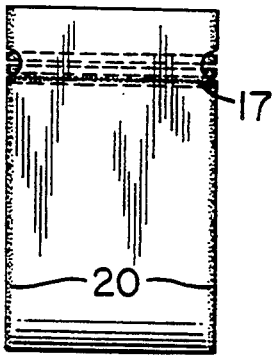
FIG. 7 is an elevational view of the gift bag of the present invention.
Figure 8:
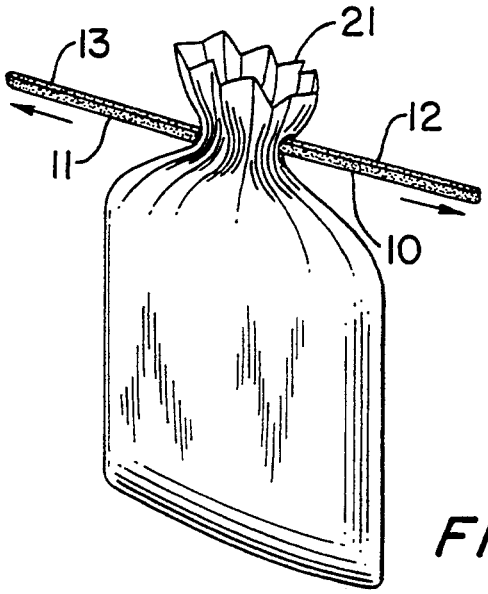
FIG. 8 is a perspective view showing the bag with each of the ribbon loops pulled in opposite directions.

The gift bag, shown in FIG. 7, has the upper and lower ribbon loops accessible at opposite ends through the semicircular portions of the punched holes. When the bag is filled, it can be closed by pulling the upper and lower ribbon loops in opposite directions, as shown in FIG. 8, to form a cluster 21 at the top of the bag. The ribbon loops can be tied around the neck below the cluster to form a fancy package.

The invention has been shown in a single preferred embodiment, and obviously many modifications and variations are possible within the spirit of the invention. The invention, therefore, is not intended to be limited to any particular form or embodiment, except insofar as such limitations are expressly set forth in the claims.

I claim:

1. A method of making a gift bag having a pair of ribbon loops which, when pulled in opposite directions, close the bag and form a cluster at the top of the bag about which the ribbons can be tied in a bow comprising: laying a pair of side-by-side longitudinally extending ribbons near opposite edges of a longitudinally extending sheet; folding the opposite edges transversely as flaps over the respective pairs of ribbons along longitudinal fold lines which become the upper ends of the bag; folding the sheet longitudinally along the middle to form the bottom and the wall panels of the bag and bringing the longitudinal fold lines forming the upper ends of the bags in side-by-side relationship; with each pair of ribbons interposed between a wall panel and a folded flap and being located in proximity to the fold line which connects the wall panel and the folded flap, punching holes through the wall panels and folded flaps at longitudinal distances corresponding to the width of the bag and at locations spaced transversely from the fold lines which connect the wall panels with their respective folded flaps to avoid punching the pairs of ribbons; displacing the pairs of ribbons transversely into registry with the punched holes; sealing the overlying wall panels, folded flaps and ribbons along a transverse zone passing through the middle of the punched hole; and cutting along the transverse zone to separate the bags.

2. A method as set forth in claim 1 including forming longitudinal seals between each wall panel and its respective folded flap by interposing a plate between the folded flaps and bringing longitudinally extending heated bars into engagement with the outer surfaces of the wall panels.

3. A method as set forth in claim 1 including continuously feeding the sheet and the ribbons while the ribbons are deposited on the sheet and intermittently advancing the ribbons and the sheet during the hole punching and heat sealing steps.

* * * * *